US009085140B2

(12) United States Patent
Yang et al.

(10) Patent No.: US 9,085,140 B2
(45) Date of Patent: Jul. 21, 2015

(54) ACTIVE CLICHE FOR LARGE-AREA PRINTING, MANUFACTURING METHOD OF THE SAME, AND PRINTING METHOD USING THE SAME

(71) Applicant: Electronics and Telecommunications Research Institute, Daejeon (KR)

(72) Inventors: Yong Suk Yang, Daejeon (KR); In-Kyu You, Daejeon (KR); Soon-Won Jung, Daejeon (KR); Bock Soon Na, Daejeon (KR); Seok-Hwan Moon, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 57 days.

(21) Appl. No.: 13/966,336

(22) Filed: Aug. 14, 2013

(65) Prior Publication Data

US 2014/0063124 A1 Mar. 6, 2014

(30) Foreign Application Priority Data

Sep. 5, 2012 (KR) ..... 10-2012-0098469
Mar. 26, 2013 (KR) ..... 10-2013-0031979

(51) Int. Cl.

| | |
|---|---|
| ***B41J 2/15*** | (2006.01) |
| ***B41J 2/14*** | (2006.01) |
| ***B41J 2/16*** | (2006.01) |
| ***B41J 2/06*** | (2006.01) |

(52) U.S. Cl.

CPC .... *B41J 2/14* (2013.01); *B41J 2/06* (2013.01); *B41J 2/16* (2013.01); *B41J 2/1621* (2013.01); *B41J 2/1629* (2013.01); *B41J 2/1631* (2013.01); *B41J 2/1639* (2013.01); *B41J 2/1642* (2013.01); *B41J 2/1646* (2013.01); *B41J 2202/04* (2013.01)

(58) Field of Classification Search

CPC ..... B41J 2/1433; B41J 2002/14362; B41J 2002/14274; B41J 2002/14419; B41J 2/135; B41J 2/14145; B41J 2/14072
USPC ..... 347/47
See application file for complete search history.

(56) References Cited

U.S. PATENT DOCUMENTS 6,663,236 B2 * 12/2003 Sharma ..... 347/98
8,277,753 B2 * 10/2012 Hasan et al. ..... 422/500
8,757,779 B2 * 6/2014 Fielder et al. ..... 347/63

FOREIGN PATENT DOCUMENTS

KR 10-2012-0001556 A 1/2012
KR 10-2012-0013770 A 2/2012
KR 10-2012-0041394 A 5/2012
KR 10-2012-0041395 A 5/2012

OTHER PUBLICATIONS

Doo-Hyeb Youn et al., "Electrohydrodynamic micropatterning of silver ink using near-field electrohydrodynamic jet printing with tilted-outlet nozzle", Applied Physics A, May 14, 2009, pp. 933-938, vol. 96, Issue 4.
Stephen Y. Chou et al., "Imprint of sub-25 nm vias and trenches in polymers", Applied Physics Letter, Nov. 1995, pp. 3114-3116, vol. 67, No. 21.

* cited by examiner

*Primary Examiner* — Lamson Nguyen
(74) *Attorney, Agent, or Firm* — Rabin & Berdo, P.C.

(57) ABSTRACT

Provided are a large-area nano-scale active printing device, a fabricating method of the same, and a printing method using the same. The printing device may include a substrate, first interconnection lines extending along a first direction, on the substrate, an interlayered dielectric layer provided on the first interconnection lines to have holes partially exposing the first interconnection lines, second interconnection lines provided adjacent to the holes in the interlayered dielectric layer to cross the first interconnection lines, and wedge-shaped electrodes provided at intersections with the first and second interconnection lines and connected to the first interconnection lines. The wedge-shaped electrodes protrude upward at centers of the holes.

14 Claims, 12 Drawing Sheets

ACTIVE CLICHE FOR LARGE-AREA PRINTING, MANUFACTURING METHOD OF THE SAME, AND PRINTING METHOD USING THE SAME

CROSS-REFERENCE TO RELATED APPLICATIONS

This U.S. non-provisional patent application claims priority under 35 U.S.C. §119 to Korean Patent Application Nos. 10-2012-0098469 and 10-2013-0031979, filed on Sep. 5, 2012 and Mar. 26, 2013, respectively, in the Korean Intellectual Property Office, the entire contents of which are hereby incorporated by reference.

BACKGROUND OF THE INVENTION

Example embodiments of the inventive concept relate to a printing device and a method of fabricating the same, and in particular, to a large-area nano-scale active printing device, a fabricating method of the same, and a printing method using the same.

In a printed electronics technology, a printing process is used to form an electronic device, part, or module. In other words, electronic devices are made of a conductive ink or a functional ink. The conductive ink or the functional ink is printed on a substrate (e.g., of plastic, paper, glass, or silicon) to form a three-dimensional structure. The printed electronics technology provides several technical advantages. For example, a large area printing can be realized using a low cost, low temperature, high speed, eco-friendly process. Further, cost-effective and flexible products can be manufactured using the printed electronics technology.

However, the printed electronics technology suffers from low performance and low integration density, which result from limitations in material and process. Although nano-scale printing technologies, such as a nano-imprinting method, an electrohydrodynamic inkjet printing method, a micro-imprinting method, and a micro-molding method, have been suggested, further study is needed to realize a nano-scale large-area printing with high performance.

Alternatively, an electrohydrodynamic inkjet printing process or an electro-spinning process has been proposed. This process makes it possible to form organic or inorganic wires having a thickness of μm-order, without additional pattering process. However, according to the conventional electro-spinning process, there is a difficulty in realizing a large-area high-performance printing, as the result of the use of nozzle.

SUMMARY

Example embodiments of the inventive concept provide a nano-scale printing device capable of realizing a large-area printing, a fabricating method of the same, and a printing method using the same.

According to example embodiments of the inventive concepts, a nano-scale printing device may include a substrate, first interconnection lines extending along a first direction, on the substrate, an interlayered dielectric layer provided on the first interconnection lines to have holes partially exposing the first interconnection lines, second interconnection lines provided adjacent to the holes in the interlayered dielectric layer to cross the first interconnection lines, and wedge-shaped electrodes provided at intersections with the first and second interconnection lines and connected to the first interconnection lines. The wedge-shaped electrodes protrude upward at centers of the holes.

In example embodiments, the wedge-shaped electrodes may be shaped like a cone.

In example embodiments, the device may further include a tip provided at an end portion of the cone-shaped wedge-shaped electrode.

In example embodiments, the tip may include a carbon nanotube.

In example embodiments, the wedge-shaped electrode may include molybdenum.

In example embodiments, at least one of the second interconnection lines may include a ring-shaped electrode surrounding the hole.

In example embodiments, the ring-shaped electrode has an internal diameter that may be greater than a width of the hole.

In example embodiments, at least one of the first interconnection lines may include a bottom plate disposed below the wedge-shaped electrode and exposed by the hole, the bottom plate being overlapped with the ring-shaped electrode.

In example embodiments, the holes have a minimum diameter of 4 μm.

In example embodiments, the holes and the wedge-shaped electrodes may be arranged at intersections between the first and second interconnection lines to have a matrix arrangement.

In example embodiments, the device may further include a data driver connected to the first interconnection lines, and a scan driver connected to the second interconnection lines.

In example embodiments, the first and second interconnection lines include at least one of gold, silver, copper, aluminum, tungsten, tantalum, titanium, or nickel.

In example embodiments, the interlayered dielectric layer may include a first interlayered dielectric layer covering the first interconnection lines, and a second interlayered dielectric layer covering the first interlayered dielectric layer and the second interconnection lines.

In example embodiments, at least one of the first and second interlayered dielectric layers may include a silicon oxide layer or a silicon nitride layer.

According to example embodiments of the inventive concepts, a method of fabricating a nano-scale printing device may include forming first interconnection lines on a substrate, forming a first interlayered dielectric layer on the first interconnection lines, forming second interconnection lines on the first interlayered dielectric layer to cross the first interconnection lines, the second interconnection lines having ring-shaped electrodes overlapped with the first interconnection lines, forming a second interlayered dielectric layer on the second interconnection line and the first interlayered dielectric layer, removing the second interlayered dielectric layer in the ring-shaped electrode and the first interlayered dielectric layer below the second interlayered dielectric layer to form holes partially exposing the first interconnection lines, and forming wedge-shaped electrodes on the first interconnection lines and in the holes.

In example embodiments, the method may further include before the forming of the holes, forming a sacrificial layer on the second interlayered dielectric layer.

In example embodiments, the forming of the wedge-shaped electrodes may include forming the wedge-shaped electrodes on the first interconnection lines and in the holes and a metal layer on the sacrificial layer, and removing the sacrificial layer to lift off the metal layer from the sacrificial layer.

In example embodiments, the metal layer and the wedge-shaped electrode may be formed using an oblique deposition process.

In example embodiments, the hole may be formed to have a diameter that may be smaller than the ring-shaped electrode.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

Figure 1:
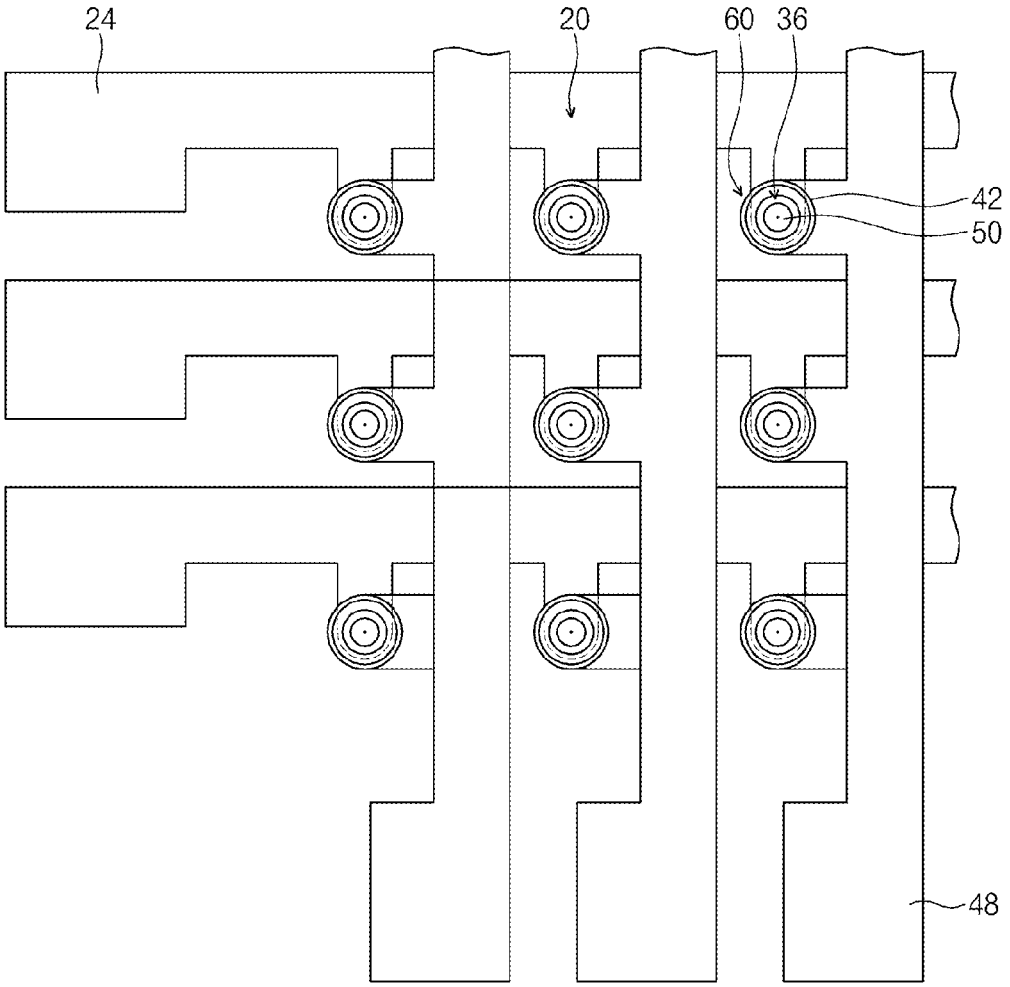
FIG. 1 is a plan view illustrating a nano-scale printing device according to example embodiments of the inventive concept.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION

Example embodiments of the inventive concepts will now be described more fully with reference to the accompanying drawings, in which example embodiments are shown. Example embodiments of the inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments of the inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the inventive concepts should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 2:
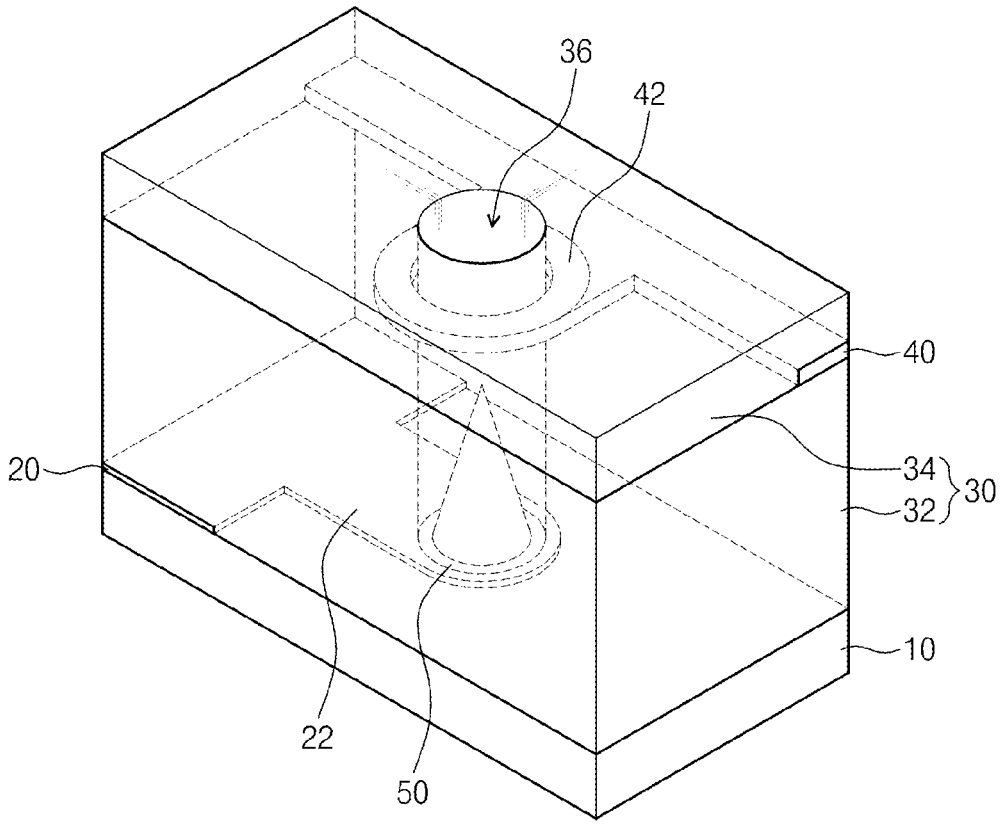
FIG. 2 is a perspective view illustrating a pixel of FIG. 1.

FIG. 1 is a plan view illustrating a nano-scale printing device according to example embodiments of the inventive concept. FIG. 2 is a perspective view illustrating a pixel of FIG. 1.

Referring to FIGS. 1 and 2, a nano-scale printing device may include a substrate 10, first interconnection lines 20, an interlayered dielectric layer 30, second interconnection lines 40, and a wedge-shaped electrode 50.

The substrate 10 may include glass or silicon. The first interconnection lines 20 may be provided on the substrate 10. The first interconnection lines 20 may extend along a first direction. The first interconnection lines 20 may include at least one of gold (Au), silver (Ag), copper (Cu), aluminum (Al), tungsten (W), chromium (Cr), nickel (Ni), or carbon nanotube. Each of the first interconnection lines 20 may include a plurality of bottom plates 22 that are provided at regular intervals. The bottom plates 22 may be extensions that are provided between the first interconnection lines 20 and are protruded toward a second direction crossing the first direction. The first interconnection lines 20 may be connected to a first pad 24. The first pad 24 may be a data driver.

The interlayered dielectric layer 30 may be provided on the first interconnection lines 20. The interlayered dielectric layer 30 may be formed to have a first hole 36 partially exposing the bottom plate 22 of the first interconnection lines 20. The first hole 36 may be formed to have a circular shape, in plan view. The first hole 36 may have a diameter of about 0.1-10 μm. In example embodiments, the first hole 36 may have a minimum diameter of about 4 μm or have a diameter of about 4 μm at least. The interlayered dielectric layer 30 may include a dielectric material, such as a silicon oxide layer or a silicon nitride layer. Alternatively, the interlayered dielectric layer 30 may include polymer. The interlayered dielectric layer 30 may include a first interlayered dielectric layer 32 and a second interlayered dielectric layer 34. The first interlayered dielectric layer 32 may be formed to cover the first interconnection lines 20. The second interlayered dielectric layer 34 may be formed to cover the second interconnection lines 40. The first and second interlayered dielectric layers 32 and 34 may include the same dielectric material.

The second interconnection lines 40 may extend along the second direction. The second interconnection lines 40 may include at least one of gold, silver, copper, aluminum, tungsten, nickel, chromium, or tantalum. The second interconnection lines 40 may include ring-shaped electrodes 42, which are provided around the first holes 36, respectively. The first hole 36 may have a width smaller than an inner diameter of the ring-shaped electrode 42. The first hole 36 has minimum diameter of 4 μm. The ring-shaped electrode 42 may be provided in the interlayered dielectric layer 30. In other words, the ring-shaped electrode 42 may not be exposed from the interlayered dielectric layer 30 in the first hole 36.

The ring-shaped electrodes 42 and the first holes 36 may be arranged along the first interconnection lines 20 and the second interconnection lines 40 to have a matrix-like arrangement. For example, the ring-shaped electrodes 42 and the first holes 36 may be provided at intersections of the first interconnection lines 20 and the second interconnection lines 40. The first interconnection lines 20 and the second interconnection lines 40 may define pixels 60. For example, each of the ring-shaped electrodes 42 and each of the first holes 36 may define the corresponding one of the pixels 60. The second interconnection lines 40 may be connected to second pads 48, respectively. The second pads 48 may be or be connected to a scan driver or a gate driver.

The wedge-shaped electrode 50 may be provided in the first hole 36. The wedge-shaped electrode 50 may include a metal, such as, molybdenum (Mo). The bottom plates 22 of the first interconnection lines 20 may be electrically connected to the wedge-shaped electrode 50. The wedge-shaped electrode 50 may be positioned at a center of the first hole 36. A distance between the wedge-shaped electrode 50 and the ring-shaped electrode 42 may range from 1 μm to 10 μm. The wedge-shaped electrode 50 is are shaped like a cone.

Figure 3:
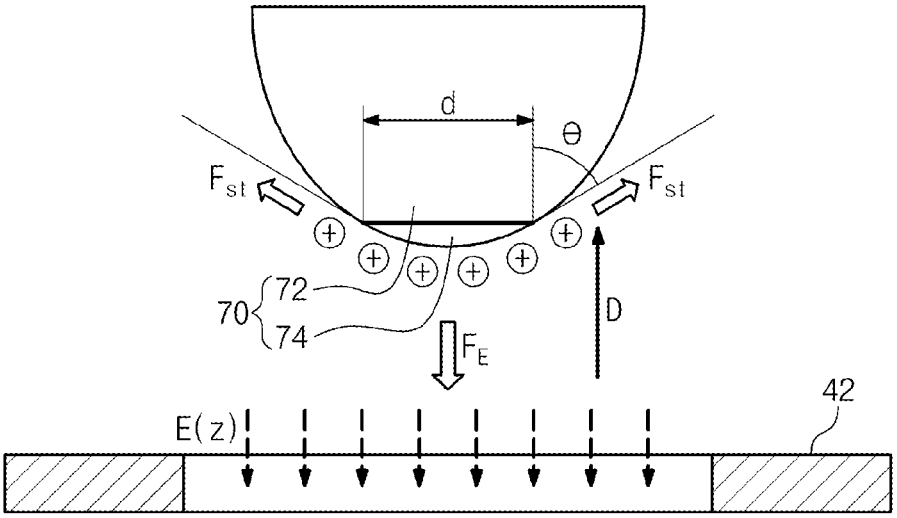
FIG. 3 is a schematic diagram illustrating an ink located between wedge-shaped and ring-shaped electrodes of FIG. 2.

FIG. 3 is a schematic diagram illustrating an ink 70 that is located between the wedge-shaped and the ring-shaped electrodes 50 and 42 of FIG. 2.

Referring to FIGS. 1 through 3, the ink 70 may be provided on an end portion of the wedge-shaped electrode 50, and a surface tension $F_{st}$ and an electromagnetic force $F_E$ may be exerted on the ink 70. The surface tension $F_{st}$ may be exerted to prevent the ink 70 from being detached from the wedge-shaped electrode 50 or attach the ink 70 to the wedge-shaped electrode 50.

The electromagnetic force $F_E$ may be exerted to tear of positively charged ink 70 from the wedge-shaped electrode 50. An electric field Ez may be given by a function of a voltage V and a distance D. For example, the voltage V may be given by a product of the electric field Ez and the distance D. If a voltage is applied between the first interconnection lines 20 and the second interconnection lines 40, the ink 70 may be charged. If the surface tension $F_{st}$ is stronger than the electromagnetic force $F_E$, the ink 70 may remain on the wedge-shaped electrode 50. If the electromagnetic force $F_E$ is stronger than the surface tension $F_{st}$, the ink 70 may be detached from the wedge-shaped electrode 50 and be moved through the ring-shaped electrode 42.

Before the detaching of the ink 70, the surface tension $F_{st}$ and the electromagnetic force $F_E$ may be in an equilibrium state. The surface tension $F_{st}$ to be exerted on the ink 70 may be given by the following Equation 1.

$$\pi d y_{st} \cos\theta = 3.14\,(100\text{ nm})(26.56\text{ mN/m})\cos 65° = 3.5\text{ nN} \quad \text{[Equation 1]}$$

where d is a diameter of the ink 70, when the ink 70 is detached, $v_{st}$ is a surface tension constant, and θ is an angle between a tangential line of the ink 70 and the electric field. According to Equation 1, if d, $v_{st}$, and θ are 100 nm, 26.56 mN/m, and 65°, the surface tension $F_{st}$ is about 3.5 nN.

The electromagnetic force $F_E$, a coulomb force, can be given by the Equation 2.

$$F_E = \frac{\varepsilon_0 \varepsilon_r}{2} \int E^2 da = \frac{8.854 \times 10^{-12} \times 40}{2} \left(\frac{200\ V}{4\ \mu m}\right)^2 3.14 \left(\frac{100\text{ nm}}{2}\right)^2 = 3.5\text{ nN} \quad \text{[Equation 2]}$$

where $\in_0$ is permittivity of air, where $\in_r$ is permittivity of the ink 70. Example, $\in_0$ is 1, and $\in_r$ is $8.854\times10^{-12}\times40$. E is given by dividing the voltage V applied between the wedge-shaped electrode 50 and the ring-shaped electrode 42 by the distance D. The voltage V is 200V and the distance D is about 4 μm. A section of the ink is supposed to be shaped like a circle with a diameter of about 100 mm. The electromagnetic force is calculated to be about 3.5 nN. The electromagnetic force $F_E$ and the surface tension $F_{st}$ in the equilibrium state have the same value.

If the electromagnetic force $F_E$ becomes stronger than the surface tension $F_{st}$, the ink 70 may be detached from the wedge-shaped electrode 50 and be printed in a nano scale. Here, the ink 70 may be divided into a remaining ink 72 and a printing ink 74. The remaining ink 72 may remain on the wedge-shaped electrode 50, and the printing ink 74 may be detached from the remaining ink 72 by an electrostatic force.

The electromagnetic force $F_E$ may be proportional to a voltage applied between the first interconnection lines 20 and the second interconnection lines 40. The pixels 60 may be configured to perform a printing process using the ink 70 in an active manner. Accordingly, the nano-scale printing device can be used to print a large area.

FIGS. 4 through 10 are perspective views exemplarily illustrating a method of fabricating the nano-scale printing device of FIG. 2.

Figure 4:
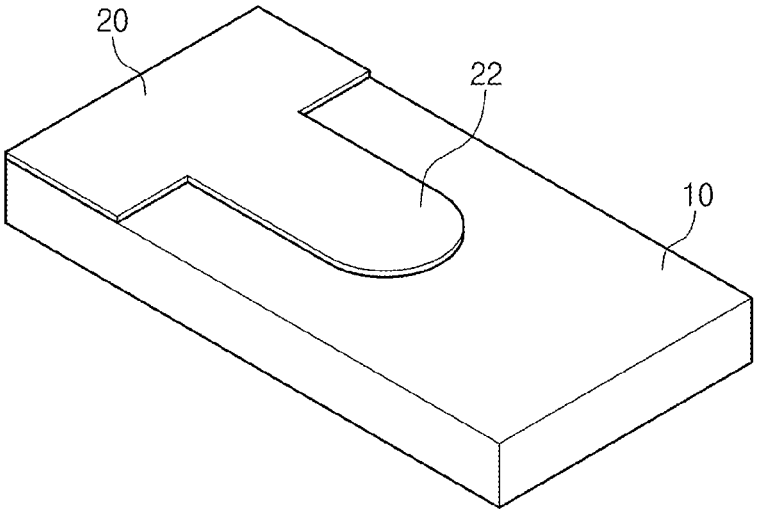
FIGS. 4 through 10 are perspective views exemplarily illustrating a method of fabricating the nano-scale printing device of FIG. 2.

Referring to FIG. 4, the first interconnection lines 20 may be formed on the substrate 10. The first interconnection lines 20 may be formed using a metal deposition process, a photolithography process, and an etching process. The metal deposition process may include a thermal evaporation, a sputtering process, or a chemical vapor deposition.

Figure 5:
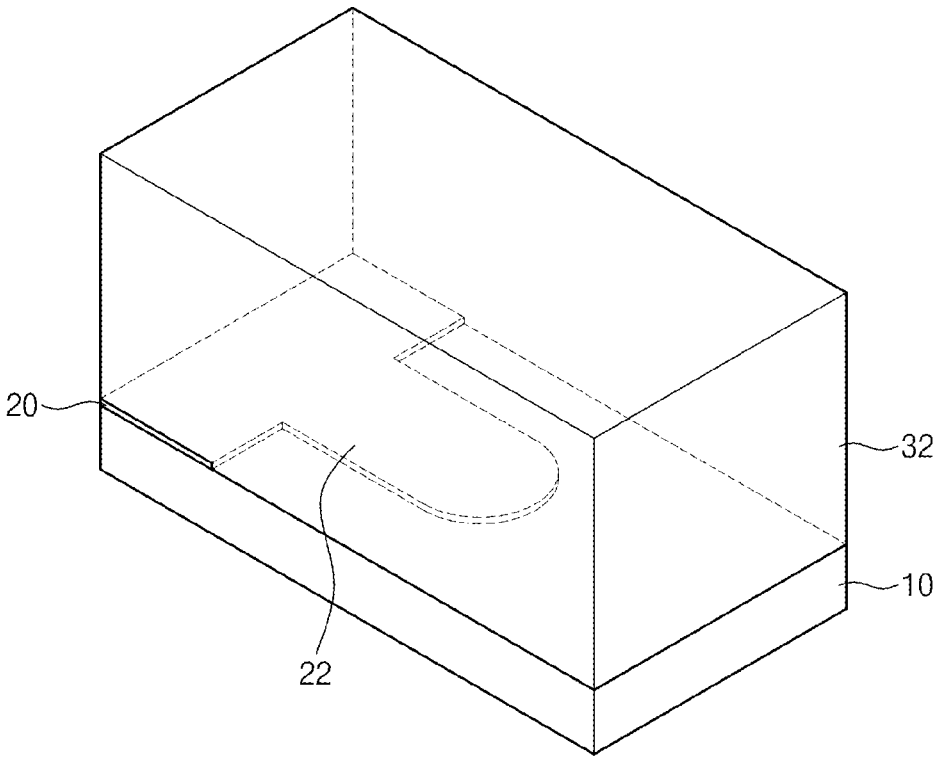

Referring to FIG. 5, the first interlayered dielectric layer 32 may be formed on the first interconnection lines 20 and the substrate 10. The first interlayered dielectric layer 32 may include a silicon oxide layer, which may be formed using a chemical vapor deposition.

Figure 6:
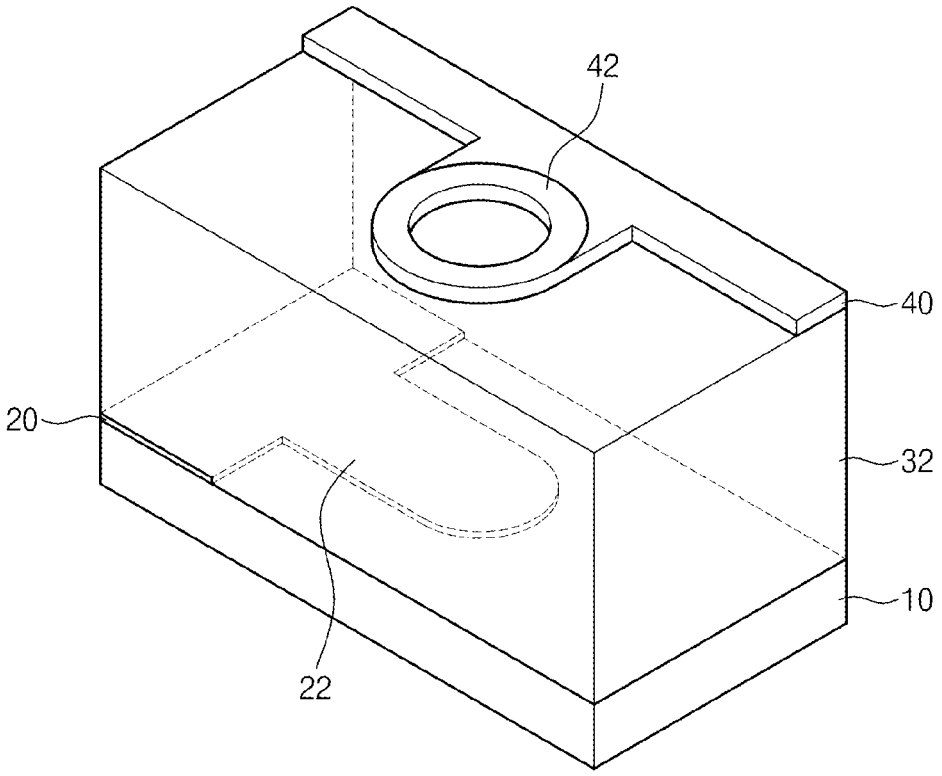

Referring to FIG. 6, the second interconnection lines 40 may be formed on the first interlayered dielectric layer 32. The second interconnection lines 40 may be formed using a metal deposition process, a photolithography process, and an etching process. The second interconnection lines 40 may include the ring-shaped electrodes 42 formed at intersections with the first interconnection lines 20. The ring-shaped electrode 42 may be provided to be overlapped with the bottom plates 22, in plan view.

Figure 7:
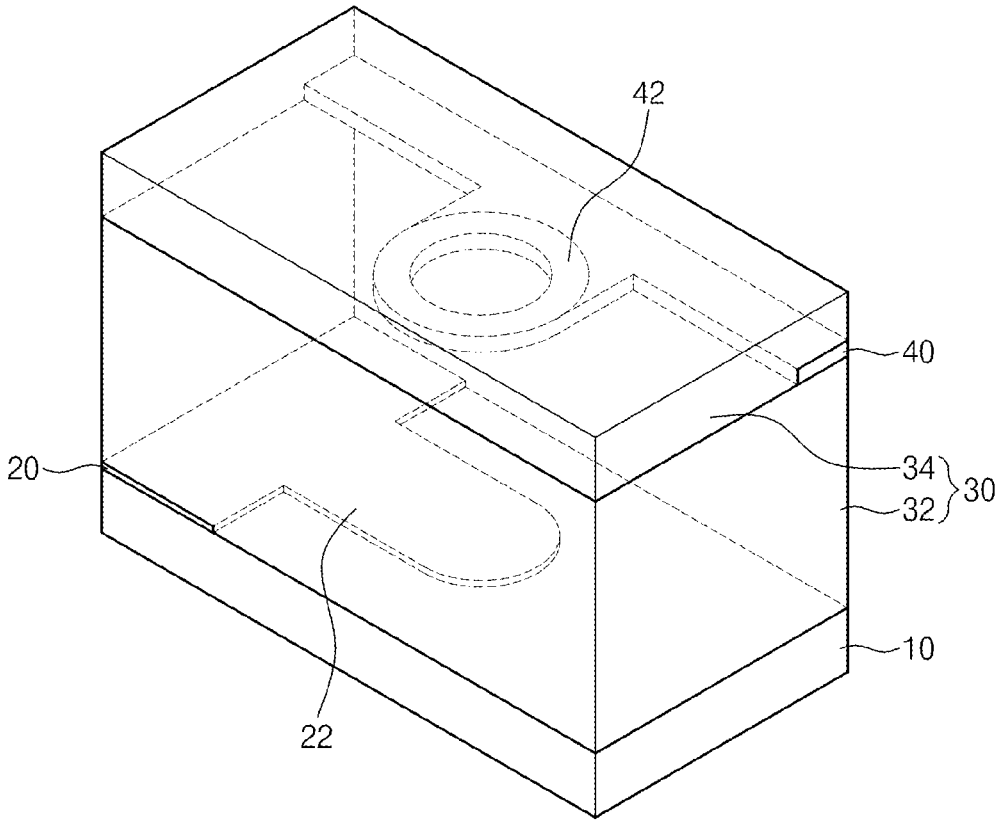

Referring to FIG. 7, the second interlayered dielectric layer 34 may be formed on the second interconnection lines 40 and the first interlayered dielectric layer 32. The second interlayered dielectric layer 34 may include a silicon oxide layer, which may be formed using a chemical vapor deposition.

Figure 8:
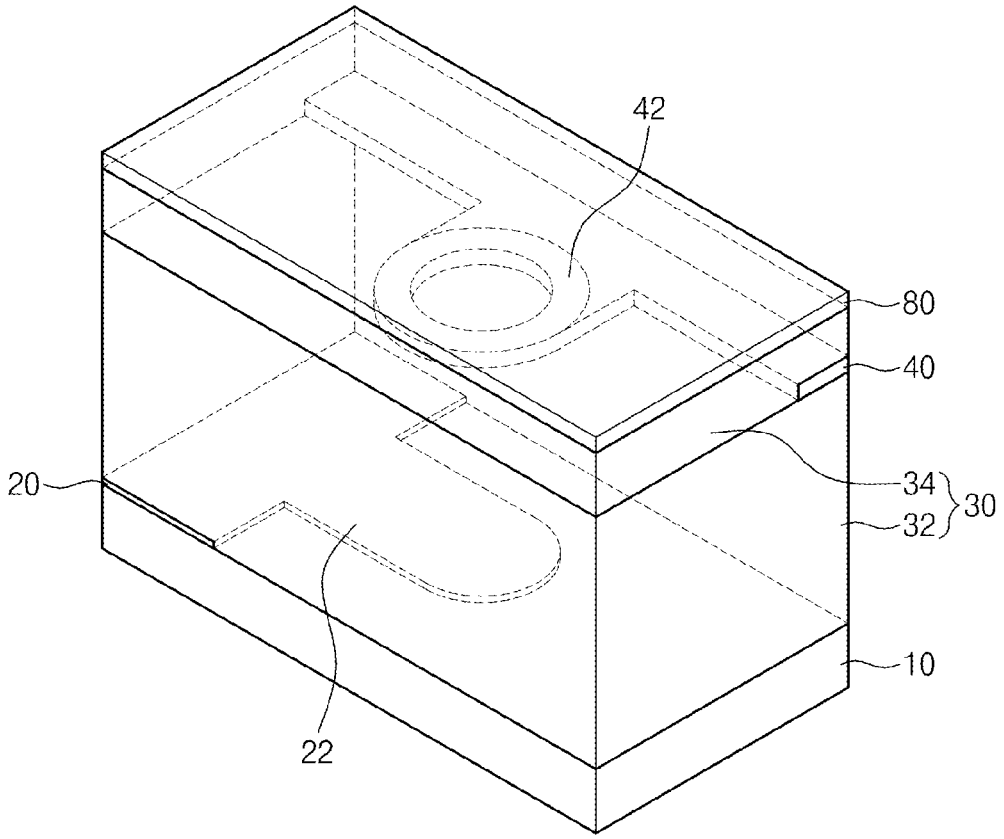

Referring to FIG. 8, a sacrificial layer 80 may be formed on the second interlayered dielectric layer 34. The sacrificial layer 80 may include a thermal oxide layer formed by a rapid thermal process (RTP) or a silicon nitride layer formed by a chemical vapor deposition. Here, the sacrificial layer 80 and the interlayered dielectric layer 30 may be formed of different material from each other.

Figure 9:
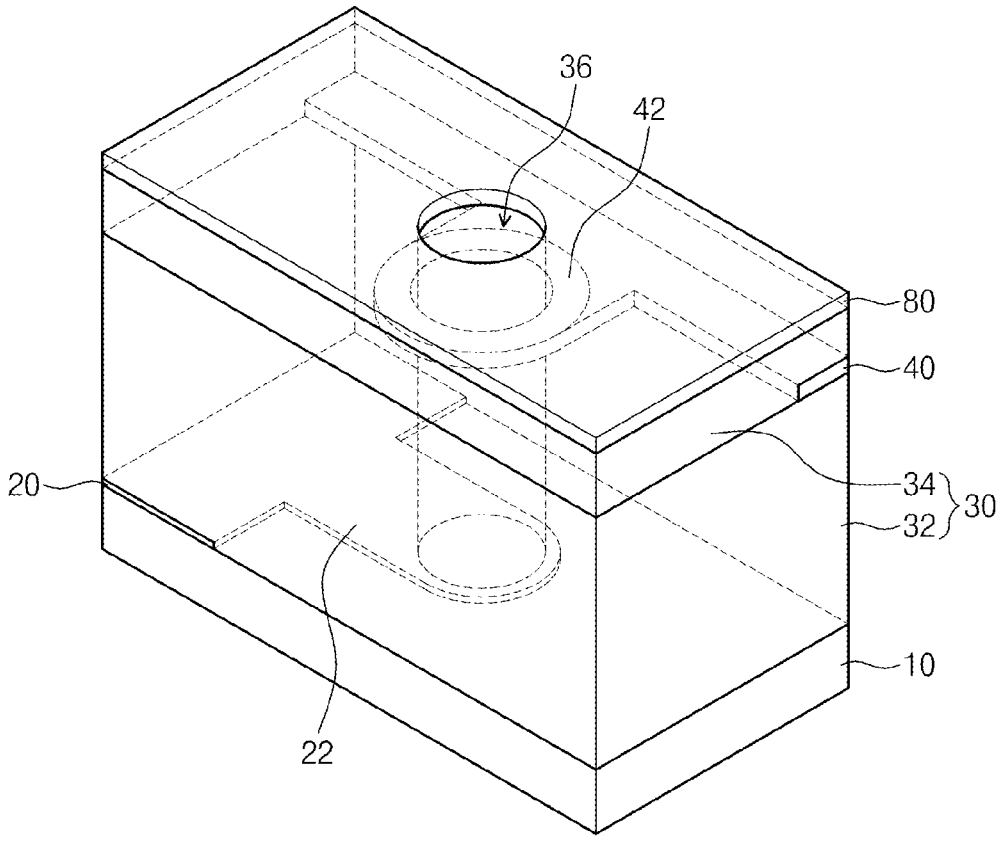

Referring to FIG. 9, the interlayered dielectric layer 30 may be partially removed to form the first hole 36 penetrating the ring-shaped electrode 42. The first hole 36 may be formed by a photolithography process and an etching process. The etching process for forming the first hole 36 may be performed in a wet etching manner. The ring-shaped electrode 42 may be formed to surround the first hole 36. The first hole 36 may be formed to expose the bottom plate 22 of the first interconnection line 20. The ring-shaped electrode 42 may be formed to have a diameter greater than the first hole 36. The second interlayered dielectric layer 34 may be covered on an inner surface of the ring-shaped electrode 42.

Figure 10:
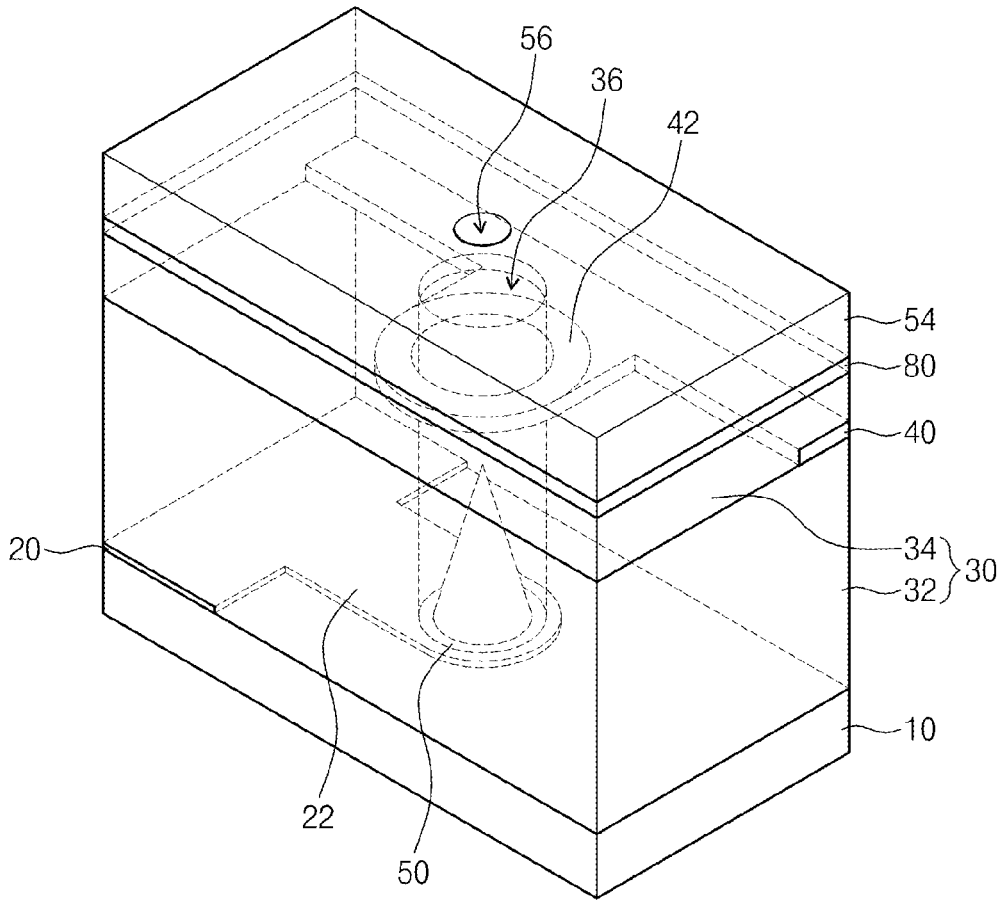

Referring to FIG. 10, the wedge-shaped electrode 50 may be formed on the bottom plate 22 in the first hole 36, and a metal layer 54 may be formed on the sacrificial layer 80. The wedge-shaped electrode 50 and the metal layer 54 may be formed using a metal inclined-plane rotation deposition technique or an oblique deposition process. In the inclined-plane rotation deposition technique, the substrate 10 may be disposed at an angle to a metal source (not shown) of the sacrificial layer 80 to form the wedge-shaped electrode 50 and the metal layer 54. The bottom surface of the wedge-shaped electrode 50 may have an area that is determined by an angle between the metal source and the substrate 10. A height of the wedge-shaped electrode 50 may be proportional to a thickness of the metal layer 54. The metal layer 54 may be formed to have a second hole 56 that is smaller than the first hole 36. A diameter of the second hole 56 may be inversely proportional to the thickness of the metal layer 54. In example embodiments, the thicker the metal layer 54, the smaller the diameter of the second hole 56. This is because an over-hang of the metal layer 54 may occur when the metal layer 54 becomes thick.

Referring to FIG. 2, the sacrificial layer 80 may be removed to lift off the metal layer 54. The sacrificial layer 80 may be removed, in a wet manner, using acidic solution. The metal layer 54 and the sacrificial layer 80 may be simultaneously removed using the same process. The first hole 36 may be re-opened. The wedge-shaped electrode 50 may remain on a center of the first hole 36.

Figure 11:
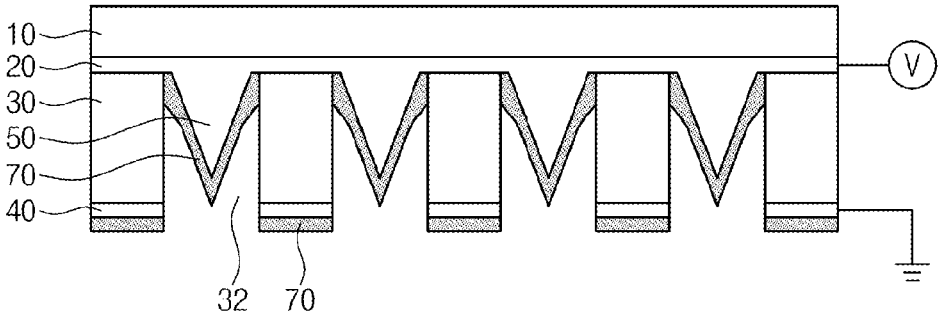
FIGS. 11 through 13 are diagrams exemplarily illustrating a printing method, which may be performed using the nano-scale printing device according to example embodiments of the inventive concept.
Figure 12:
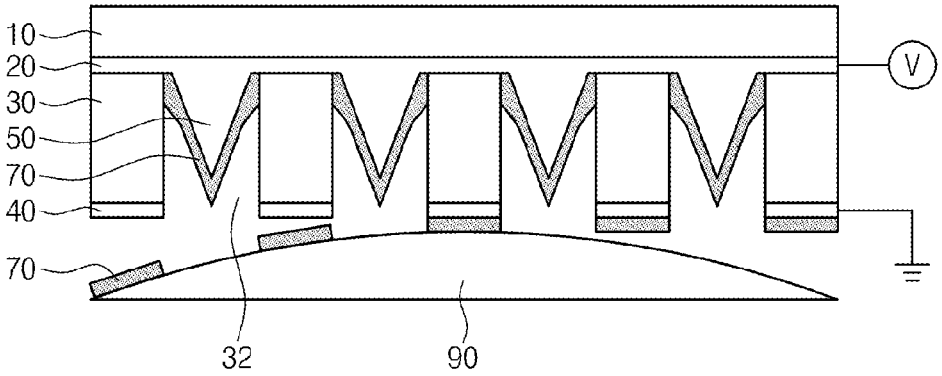
Figure 13:
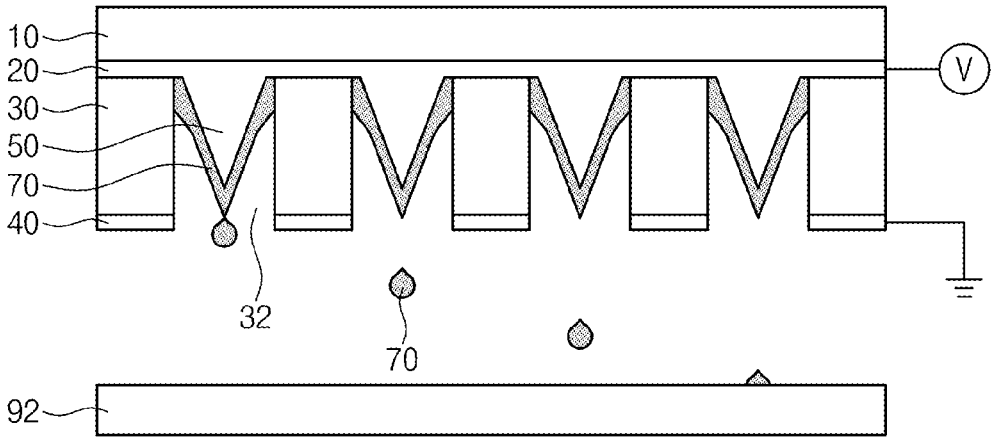

FIGS. 11 through 13 are diagrams exemplarily illustrating a printing method, which may be performed using the nano-scale printing device according to example embodiments of the inventive concept.

Referring to FIGS. 2 and 11, the ink 70 may be coated on the wedge-shaped electrode 50 and the second interconnection line 40. The coating of the ink 70 may be performed using a dipping process, a roll-printing process, or a spraying process. Although not shown, the ink 70 may be coated on the interlayered dielectric layer 30. Thereafter, the ink 70 may be heated to dry a portion thereof.

Referring to FIGS. 2 and 12, the ink 70 may be selectively removed from the second interconnection line 40. However, the ink 70 may remain in the first hole 36 and cover the wedge-shaped electrode 50. The removal of the ink 70 may be performed using a cleaning roll 90. The cleaning roll 90 may remove the ink 70 from the interlayered dielectric layer 30. The ink 70 may be cleaned. It may be operated by a cliché or printer.

Referring to FIG. 13, a voltage may be applied between the first and second interconnection lines 20 and 40 to detach the ink 70 electromagnetically from the wedge-shaped electrode 50. The ink 70 may be printed on a target substrate 92. The target substrate 92 may be oppositely charged from the wedge-shaped electrode 50. For example, the target substrate 92 may be negatively charged. The voltage may be continuously applied between the first and second interconnection lines 20 and 40, for a specific duration.

In example embodiments, the ink 70 may be detached from all of the wedge-shaped electrodes 50 that are connected to one of the first and second interconnection lines 20 and 40. The voltage may be applied in the form of pulse. The ink 70 may be alternatingly or successively dropped from the wedge-shaped electrodes 50, depending on the pulsating voltage.

Although not shown, the ink 70 may be vertically stacked on the target substrate 92. Further, the ink 70 may be naturally or thermally dried to form a printed device. The printed device may be formed on the target substrate 92 to have a 3D structure or a large area.

Figure 14:
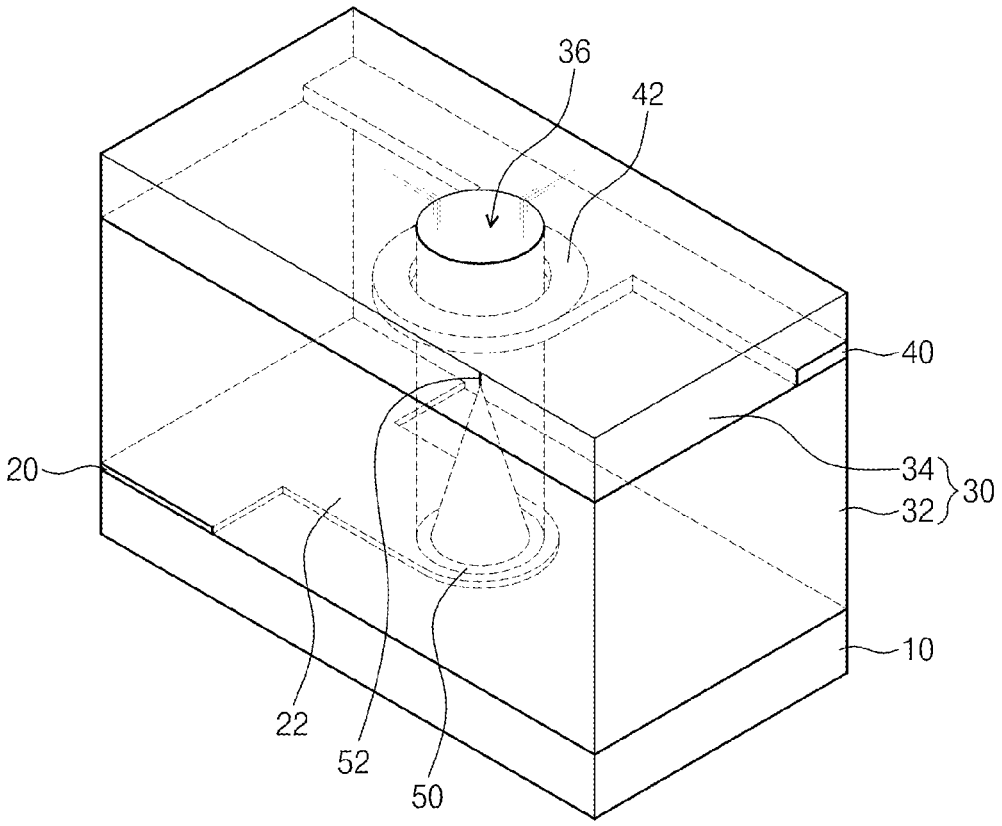
FIG. 14 is a perspective view illustrating a nano-scale printing device according to an application example of the inventive concept.

FIG. 14 is a perspective view illustrating a nano-scale printing device according to an application example of the inventive concept.

Referring to FIG. 14, the nano-scale printing device, according to example embodiments of the inventive concept, may include a tip 52 that is connected to an end portion of the wedge-shaped electrode 50. The tip 52 may be configured to adjust a distance between the wedge-shaped electrode 50 and the ring-shaped electrode 42. The tip 52 may include a carbon nanotube (CNT). In example embodiments, the tip 52 may be provided on the wedge-shaped electrode 50. Due to the presence of the tip 52, it is possible to control the distance between the wedge-shaped electrode 50 and the ring-shaped electrode 42 with ease.

According to example embodiments of the inventive concept, the nano-scale printing device may include the substrate, the first interconnection lines, the interlayered dielectric layer, the second interconnection lines, and the wedge-shaped electrodes. The first interconnection lines may extend along a first direction, the substrate. The interlayered dielectric layer may cover the first interconnection lines and have holes partially exposing the first interconnection lines. The second interconnection line may be provided on the interlayered dielectric layer to extend along a second direction. The second interconnection line may include ring-shaped electrodes surrounding the holes. The wedge-shaped electrodes may be provided on the first interconnection lines and in the holes. An ink may be coated on the wedge-shaped electrodes. The ink may be detached from the wedge-shaped electrodes using an electromagnetic force. The electromagnetic force may be induced between the wedge-shaped electrodes and the ring-shaped electrodes. The first and second interconnection lines may define pixels. The wedge-shaped electrodes and the ring-shaped electrodes may correspond to the pixels. The first and second interconnection lines may be connected to a data driver and a scan driver, respectively. The pixels may be operated in an active manner by signals from the data driver and the scan driver.

Accordingly, the nano-scale printing device can be used to print a large area.

While example embodiments of the inventive concepts have been particularly shown and described, it will be understood by one of ordinary skill in the art that variations in form and detail may be made therein without departing from the spirit and scope of the attached claims.

What is claimed is:

1. A nano-scale printing device, comprising:

a substrate;

first interconnection lines extending along a first direction, on the substrate;

an interlayered dielectric layer provided on the first interconnection lines to have holes partially exposing the first interconnection lines;

second interconnection lines provided adjacent to the holes in the interlayered dielectric layer to cross the first interconnection lines; and wedge-shaped electrodes provided at intersections with the first and second interconnection lines and connected to the first interconnection lines, wherein the wedge-shaped electrodes protrude upward at centers of the holes.

2. The device of claim 1, wherein the wedge-shaped electrodes are shaped like a cone.

3. The device of claim 2, further comprising a tip provided at an end portion of the cone-shaped wedge-shaped electrode.

4. The device of claim 3, wherein the tip comprises a carbon nanotube.

5. The device of claim 1, wherein the wedge-shaped electrode comprises molybdenum.

6. The device of claim 1, wherein at least one of the second interconnection lines comprises a ring-shaped electrode surrounding the hole.

7. The device of claim 6, wherein the ring-shaped electrode has an internal diameter that is greater than a width of the hole.

8. The device of claim 7, wherein at least one of the first interconnection lines comprises a bottom plate disposed below the wedge-shaped electrode and exposed by the hole, the bottom plate being overlapped with the ring-shaped electrode.

9. The device of claim 7, wherein the holes have a minimum diameter of 4 μm.

10. The device of claim 1, wherein the holes and the wedge-shaped electrodes are arranged at intersections between the first and second interconnection lines to have a matrix arrangement.

11. The device of claim 1, further comprising:

a data driver connected to the first interconnection lines; and a scan driver connected to the second interconnection lines.

12. The device of claim 1, wherein the first and second interconnection lines comprise at least one of gold, silver, copper, aluminum, tungsten, tantalum, titanium, or nickel.

13. The device of claim 12, wherein at least one of the first and second interlayered dielectric layers comprises a silicon oxide layer or a silicon nitride layer.

14. The device of claim 1, wherein the interlayered dielectric layer comprises:

a first interlayered dielectric layer covering the first interconnection lines; and a second interlayered dielectric layer covering the first interlayered dielectric layer and the second interconnection lines.

* * * * *